US005929880A

United States Patent [19]

Gotoda et al.

[11] Patent Number: 5,929,880

[45] Date of Patent: Jul. 27, 1999

[54] POWDER PARTICLE JUMPING RECORDING APPARATUS FOR DIRECTLY FORMING AN IMAGE ON A RECORDING MATERIAL

[75] Inventors: Katsuhiko Gotoda; Hisanobu Inada; Fumio Kondo; Susumu Shoji, all of Kobe, Japan

[73] Assignees: Ito Communication Ltd, Hong Kong, The Hong Kong Special Administrative Region of the People's Republic of China; Ito Incorporated, Tokyo, Japan

[21] Appl. No.: 08/822,211

[22] Filed: Mar. 21, 1997

[51] Int. Cl.[6] ..... B41J 2/06

[52] U.S. Cl. ..... 347/55; 347/141

[58] Field of Search ..... 347/55, 112, 141

[56] References Cited

U.S. PATENT DOCUMENTS

| | | | |
|---|---|---|---|
| 5,526,029 | 6/1996 | Larson et al. | 347/55 |
| 5,559,544 | 9/1996 | Sato | 347/127 |
| 5,666,147 | 9/1997 | Larson | 347/112 |

FOREIGN PATENT DOCUMENTS

| | | |
|---|---|---|
| 60-119592 | 6/1985 | Japan . |
| 62-126302 | 6/1987 | Japan . |
| 1-503221 | 11/1989 | Japan . |
| 2-2034 | 1/1990 | Japan . |
| 3-44670 | 2/1991 | Japan . |
| 3-168770 | 7/1991 | Japan . |
| 4-505899 | 10/1992 | Japan . |

OTHER PUBLICATIONS

Author: Tsutomu Shohdohji et al. Title: "An Evaluation and image formation of Toner Jumping Method for Non–Impact Printing (Part 1)", *Image Electronics Institute Journal*, 1993, pp. 255–262, vol. 22–3, by Image Electronics Institute in Japan.

*Primary Examiner*—William Royer
*Assistant Examiner*—Quana Grainger
*Attorney, Agent, or Firm*—Koda & Androlia

[57] ABSTRACT

A powder particle lumping recording apparatus low in cost and high in printing quality is disclosed. Toner 12 having a magnetic property contained in a toner container 21 is conveyed by a developing roller 11 constituting a magnet roller, and jumped under the effect of the electric field controlled by a control electrode formed on an FPC 22. The toner 12 is accelerated by the acceleration voltage for the conductive roller 15, attaches on a recording material inserted between the control electrode 13 and the conductive roller 15, and thus forms an image. The conductive roller 15 contains a magnet 16 therein. With the approach of the magnet 16 to the control electrode 13 by rotation of the conductive roller 15, the toner 12 can be attracted off. The toner 12 attached on the surface of the conductive roller 15 is mechanically removed by a cleaning blade 17 and accumulated in a housing 18. The conductive roller 15, the cleaning blade 17 and the housing 18 make up an easily-demountable cleaning unit 19.

8 Claims, 5 Drawing Sheets

POWDER PARTICLE JUMPING RECORDING APPARATUS FOR DIRECTLY FORMING AN IMAGE ON A RECORDING MATERIAL

BACKGROUND OF THE INVENTION

1. Field of the Invention

The present invention relates to a powder particle jumping recording apparatus for forming an image by attaching a developer in powder particle form directly on a recording material without forming any electrostatic latent image.

2. Description of the Related Art

Conventionally what is called the electrophotographic recording apparatus has been widely used for the duplicator, facsimile, printer or the like. In the electrophotography invented in 1938 by P. F. Carlson, an electrostatic latent image is formed on a photoconductive light-sensitive material, and a toner constituting a charged powdery developer is adsorbed on it. Then the toner is transferred to a recording material to form an image, and fused by being heated for recording. With this electrophotography, the light-sensitive material used for forming an electrostatic latent image is expensive, and the maintenance cost is high. In recent years, the powder particle jumping recording technique has been proposed in Japanese Unexamined Patent Publication of an international application, JP-A 1-503221 (1989) and in a publication entitled "Forming Image by Powder Particle Flying Recording System and Evaluation" (first report), Image Electronics Society Journals Vol.22, No.3, 1993, pp.255–262.

FIG. 7 shows a principle of the powder particle jumping recording process based on FIG. 2 shown on page 255 of the above-mentioned publication. A developing roller 1 magnetically attracts toner 2 having a magnetic surface and conveys it to a recording section. In the recording section, a control electrode 3, a recording paper 4 and a back electrode 5 are arranged to be spaced from the surface of the developing roller 1. Upon application of a voltage to the control electrode 3 in such a manner as to attract the toner 2, the toner 2 is attracted by the Coulomb force based on the electric field generated from the control electrode 3 larger than the magnetic attraction exerted on the developing roller 1, and the toner jumps from the surface of the developing roller 1. The back electrode 5 is impressed with a high DC potential and accelerates the jumping toner 2. In the control electrode 3 are formed through holes through which the toner 2 is allowed to pass. The toner 2 thus accelerated is attached on the recording paper 4 inserted between the control electrode 3 and the back electrode 5 to form an image.

The prior art relating to a powder particle jumping recording apparatus are disclosed also in Japanese Unexamined Patent Publication JP-A 3-168770 (1991) and Japanese Unexamined Patent Publication of an internatioal application, JP-A 4-505899 (1992). The apparatus disclosed in JP-A 3-168770 has such a configuration that a toner carrier corresponding to the developing roller and toner passage means corresponding to the control electrode are integrated with each other as a single unit removable from the back electrode. JP-A 4-505899, on the other hand, discloses a technique in which the extraneous toner attached on the surface of the control electrode is cleaned off by a magnet contained in the developing roller.

In the prior arts described above, the back electrode assumes a tabular or a similar shape, and therefore the accelerated toner is liable to be scattered over a wide range.

The scattering tendency of the toner often causes the toner to attach on the control electrode. JP-A 4-505899 discloses a configuration for cleaning the toner off from the control electrode by the magnetic force on the developing roller. In the case where a recording material is not loaded between the control electrode and the back electrode, however, the toner is liable to transfer to the back electrode, and any configuration is not disclosed for cleaning the toner that has transferred to the back electrode.

SUMMARY OF THE INVENTION

Hence an object of the present invention is to provide a powder particle jumping recording apparatus in which parts corresponding to the control electrode and the back electrode can be easily cleaned and a superior image of high recording quality can be formed at low cost.

In a first aspect of the invention there is provided a powder particle jumping recording apparatus comprising:

a developer carrier for holding a powdery developer having a magnetic property, a printing control electrode disposed so as to be spaced from the developer carrier, and an accelerating electrode disposed so as to be spaced from the developer carrier, the developer being jumped by electric field control of the printing control electrode to be accelerated by the accelerating electrode and attached on a recording material inserted between the printing control electrode and the accelerating electrode to be recorded as an image, wherein the acceleration electrode is composed of an conductive roller partially containing a magnet and is capable of cleaning the developer attached on the printing control electrode by electric and magnetic fields in a state that the recording material is not inserted, the apparatus further comprising a cleaning blade for making contact with a surface of the conductive roller of the accelerating electrode to remove the developer attached on the surface of the conductive roller.

Even in the case where the powdery developer which is jumped from the developer carrier by the printing control electrode for controlling the electric field attaches on the printing control electrode when an image is formed on the recording material, the printing control electrode can be cleaned by the electric and magnetic fields derived from the accelerating electrode in the state that the recording material is not inserted. The developer that has been attracted to the accelerating electrode composed of the conductive roller by the electric and magnetic fields is removed mechanically from the surface of the conductive roller by the cleaning blade. In forming an image by the developer on the recording material, the accelerating electrode for supplying an acceleration voltage can be used to clean the printing control electrode in the absence of the recording material, and therefore the deterioration in quality which otherwise might be caused by the extraneous developer attached on the printing control electrode can be efficiently prevented.

As described above, according to the first aspect of the invention, the developer for generating an image can be efficiently accelerated and the developer attached on the printing control electrode can be efficiently removed by the use of the accelerating electrode composed of the conductive roller. Also, the developer attached on the accelerating electrode is mechanically removed by the cleaning blade and therefore the surface of the accelerating electrode can be kept clean.

In a second aspect of the invention, there is provided a powder particle jumping recording apparatus further comprising a removable printing unit including the developer carrier and the printing control electrode, and a removable cleaning unit including the accelerating electrode and the cleaning blade.

Since the printing unit including the developer carrier and the printing control electrode and the cleaning unit including the accelerating electrode and the cleaning blade are removable, the maintenance and other work can be easily accomplished. Especially, the cleaning unit, on which the developer removed by the cleaning blade from the surface of the accelerating electrode is accumulated, can be demounted and cleaned sufficiently.

According to the second aspect of the invention, the printing unit and the cleaning unit are removable and therefore the maintenance work is facilitated. Especially, the cleaning unit, on which the developer removed from the accelerating electrode by the cleaning blade is accumulated, can be demounted, thereby recovering or disposing of the accumulated developer.

In a third aspect of the invention, there is provided a powder particle jumping recording apparatus, wherein the magnet contained in the accelerating electrode composed of the conductive roller forms magnetic poles in a part of the surface of the conductive roller.

Since the magnet contained in the accelerating electrode composed of the conductive roller forms magnetic poles in a part of the surface of the conductive roller, the positions of the magnetic poles change around the axis of the conductive roller with the rotation of the conductive roller. In performing the recording operation with the recording material inserted between the printing control electrode and the accelerating electrode, therefore, the magnetic poles of the magnet are located far from the printing control electrode, so that the jumping developer can be controlled accurately by the electric field without being affected by the magnetic force. Also, in cleaning the printing control electrode in the state that the recording material is not inserted, the surface of the accelerating electrode in which the magnetic poles are formed is moved toward the printing control electrode, thereby making it possible to efficiently remove the developer attached on the printing control electrode.

According to the third aspect of the invention, since magnetic poles are formed on the surface of the accelerating electrode composed of the conductive roller by a magnet contained therein the developer attached on the printing control electrode can be efficiently removed by magnetic force in the case where the magnetic poles are directed to the printing control electrode side by rotating and driving the conductive roller. By rotating and driving the surface in which the magnetic poles are formed, so as to be away from the printing control electrode, it is made possible to reduce the effect of the magnetic force on attraction of the developer and accurately control the process of jumping the developer by the electric field.

In a fourth aspect of the invention, there is provided a powder particle jumping recording apparatus wherein the magnet is arranged spirally in the conductive roller.

Since the magnet is arranged in spiral form in the conductive roller, the magnetic poles are formed at different surface positions along the axial direction of the conductive roller. As long as the magnetic poles in the surface of the conductive roller are directed to the developer carrier, a large magnetic attraction is generated, thereby increasing a torque for rotating the conductive roller. Since the magnet is arranged spirally in the conductive roller, linear magnetic poles along the axial direction are not formed but magnetic poles whose positions change along the axial direction are formed. Consequently smooth rotation can be assured without requiring a large torque at a specific position.

According to the fourth aspect of the invention, the magnet is arranged spirally in the conductive roller, and therefore, the attraction between the developer carrier and the magnetic poles is distributed appropriately in accordance with the rotational angle of the conductive roller. A situation thus can be avoided in which a large rotational torque is required at a specific angle.

In a fifth aspect of the invention, there is provided a powder particle jumping recording apparatus further comprising position detecting means for detecting a position of the magnet contained in the conductive roller.

Since the position of the magnet contained in the conductive roller is detected, the mode in which the magnetic poles of the magnet move away from the printing control electrode and the mode in which the magnetic poles approach the printing control electrode can be detected and switched.

According to the fifth aspect of the invention, since the position of the magnet contained in the conductive roller can be detected by the position detecting means, switching is easy between the cleaning mode in which the magnetic poles formed on the surface of the conductive roller are directed in opposed relation to the printing control electrode and the recording mode in which the magnetic poles formed on the surface of the conductive roller move away from the printing control electrode.

According to a sixth aspect of the invention, there is provided a powder particle jumping recording apparatus further comprising control means for controlling the developer carrier and the accelerating electrode in such a manner that the developer carrier is rotating while the accelerating electrode is stationary, and the accelerating electrode is rotating while the developer carrier is stationary, wherein the developer carrier is roller-shaped.

Since the developer carrier is roller-shaped, the rotation of the developer carrier causes the developer to be supplied anew from a source such as a developer tank to the printing control electrode, to which the developer thus is jumped and accelerated by the accelerating electrode. On the other hand, the accelerating electrode is rotated for the purpose of cleaning the developer attached on the printing control electrode while the developer carrier is kept stationary. The developer, therefore, is not supplied anew, thus making it possible to efficiently absorb the developer attached on the printing control electrode.

Further, according to the sixth aspect of the invention, the developer carrier is roller-shaped, and therefore the developer carrier carrying the developer on the surface thereof can convey the developer to the printing control electrode. While the developer carrier is in rotation, the accelerating electrode is kept stationary, thereby making it possible to control the electric field stably for forming an image. With the rotation of the accelerating electrode, the developer carrier is kept stationary, and the developer is not supplied anew. In this way, only the developer attached on the printing control electrode can be attracted and the printing control electrode is cleaned efficiently.

Further in a seventh aspect of the invention, there is provided a powder particle jumping recording apparatus, wherein the printing control electrode is formed on a flexible printed wiring board, the apparatus further comprising a spacer made of an elastic material having a thickness of 0.2 mm or less, interposed between the developer carrier and the flexible printed wiring board.

The printing control electrode is formed on the flexible printed wiring board and therefore can be processed with high accuracy. The interposition of the spacer made of an elastic material having a thickness of 0.2 mm or less between the developer carrier and the flexible printed wiring board can keep a highly accurate interval between the developer carrier and the printing control electrode.

According to the seventh aspect of the invention, by the use of the spacer made of the elastic material having a thickness of 0.2 mm or less, the flexible printed wiring board formed on the printing control electrode can be arranged below the surface of the developer carrier so as to keep a highly accurate space from the surface.

Further in an eighth aspect of the invention there is provided a powder particle jumping recording apparatus, wherein the elastic member is made of a conductive elastic material, or an elastic material containing an insulating material as a main component thereof which insulating material is located at a position in the electrification rank to cause the developer to be electrified with a predetermined charge under the friction between the insulating material and the developer.

Since the elastic member interposed between the developer carrier and the printing control electrode contains a conductive elastic material, or an insulating material as a main component thereof which insulating material is located at a position in the electrification rank to cause the developer to be electrified with a predetermined charge under the friction between the insulating material and the developer the electric field can be controlled by the printing control electrode and the developer can be accelerated by the accelerating electrode with high accuracy by fully charging the developer when rotating the roller constituting the developer carrier.

According to the eighth aspect of the invention, since the elastic member interposed between the developer carrier and the flexible printed wiring board can electrify the developer with a predetermined charge under the friction with the developer, an image can be formed with high accuracy by controlling the electric field by means of the printing control electrode and the accelerating electrode.

According to a ninth aspect of the invention, there is provided a powder particle jumping recording apparatus, wherein the developer carrier in roller form is rotatably supported on the outer peripheral surfaces at the axial ends thereof.

Although the developer carrier in roller form is normally supported rotatably at the ends of the central axis thereof, it is difficult to keep the central axis and the cylindrical surface of the roller in accurately concentric relation to each other, and therefore the interval between the control electrode and the developer carrier in roller form is liable to undergo a fluctuation. As far as the developer carrier in roller form is supported on the outer peripheral surface, a highly accurate image recording is possible substantially without fluctuation in the interval with the printing control electrode.

According to the ninth aspect of the invention, the developer carrier in roller form is rotatably supported on the outer peripheral surface thereof, and therefore highly accurate relative positions can be maintained without any wobbling.

In a tenth aspect of the invention, there is provided a powder particle jumping recording apparatus, wherein the flexible printed wiring substrate in which the printing control electrode is formed is pressed by a foamed elastic band extending in the axial direction of the developer carrier in roller form.

The surface of the flexible printed wire substrate is pressed by the foamed elastic band extending in the axial direction of the developer carrier in roller form, and therefore the surface of the flexible printed wire substrate is prevented from waving.

According to the tenth aspect of the invention, since the flexible wiring substrate in which the printing control electrode is formed is pressed by the foamed elastic band, the flexible printed wiring board is prevented from waving.

In an eleventh aspect of the invention, there is provided a powder particle jumping recording apparatus further comprising an electrode for applying a voltage for repelling the developer jumped by the printing control electrode and accelerated by the accelerating electrode, the electrode being arranged around the accelerating electrode.

Since the electrode for applying a voltage for repelling the developer accelerated by the accelerating electrode is arranged around the accelerating electrode, the developer is prevented from spreading around the accelerating electrode. Consequently the image formed is improved in resolution, and the surrounding portions of the accelerating electrode are prevented from being contaminated by the developer.

According to the eleventh aspect of the invention, since a voltage can be applied in such a manner as to prevent the spread of the developer around the accelerating electrode, the resolution of the image formed is improved and the contamination around the accelerating electrode is prevented.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
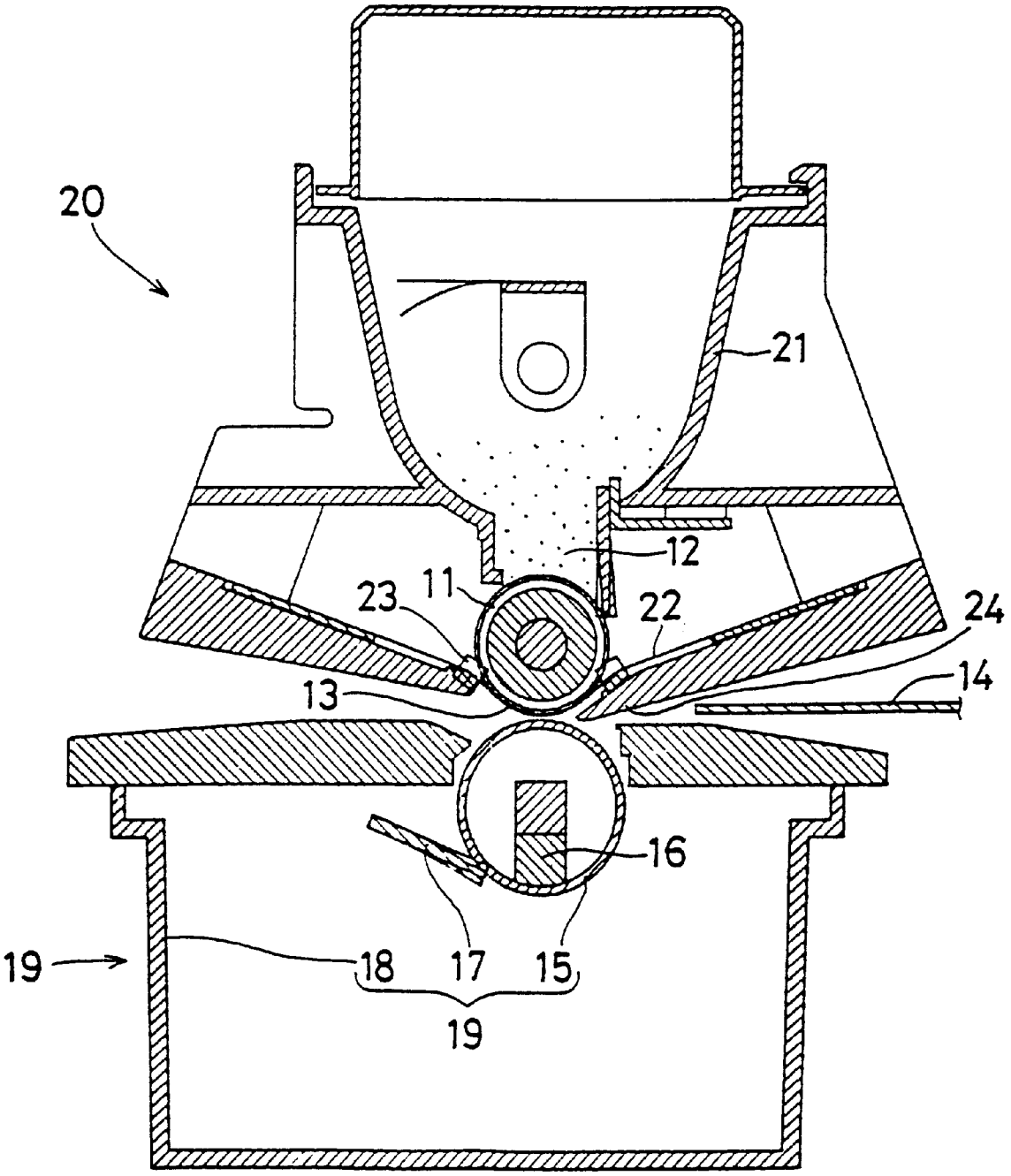
FIG. 1 is a simplified sectional view showing an embodiment of the present invention.

Now referring to the drawings, preferred embodiments of the invention are described below.

FIG. 1 shows a sectional configuration of a powder particle jumping recording apparatus as a first embodiment of the invention. A developing roller 11 is a magnet roller magnetized over the entire surface thereof and can convey by magnetically attracting the toner 12 having a magnetic property. A control electrode 13 is arranged to be slightly spaced from the surface of the developing roller 11. Further, a conductive roller 15 is arranged to be spaced from the control electrode 13 so that a recording material 14 like a sheet of recording paper or an OHP sheet can be inserted therebetween. The conductive roller 15 contains a magnet 16 in a part thereof. The surface of the conductive roller 15 is in contact with a cleaning blade 17. The conductive roller 15 and the cleaning blade 17 are encased in a housing 18 and constitute a cleaning unit 19.

The developing roller 11 is installed in a printing unit 20 and supplied with the toner 12 from a toner container 21. The control electrode 13 is formed into an electrode pattern on the flexible printed circuit board (hereinafter abbreviated as FPC) 22. Elastic foamed material layers 23 such as urethane sheets are interposed between the FPC 22 and the developing roller 11. A recording member guide 24 is arranged around the control electrode 13.

The cleaning unit 19 and the printing unit 20 are both demountable. By demounting the cleaning unit 19, the toner 12 removed from the surface of the conductive roller 15 by the cleaning blade 17 can be easily extracted from the housing 18 to be recovered for reuse or to be disposed of. With the printing unit 20 demounted, on the other hand, the maintenance work around the control electrode 13 or refilling of the toner 12 in the toner container 21 can be easily carried out.

Figure 2:
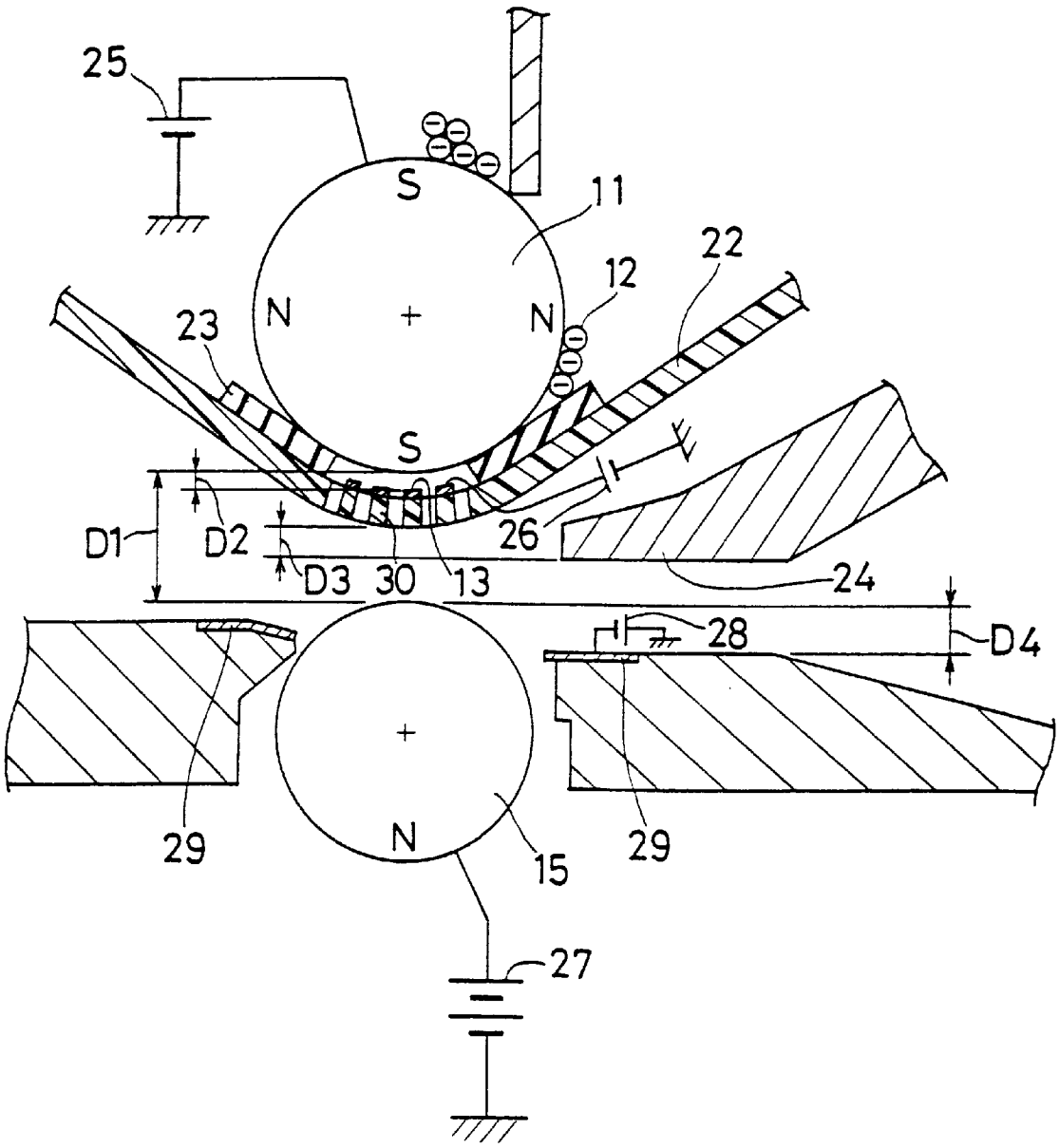
FIG. 2 is a simplified sectional view of a part of the embodiment of FIG. 1, showing a manner of electric field control in relation to formation of an image.
Figure 3:
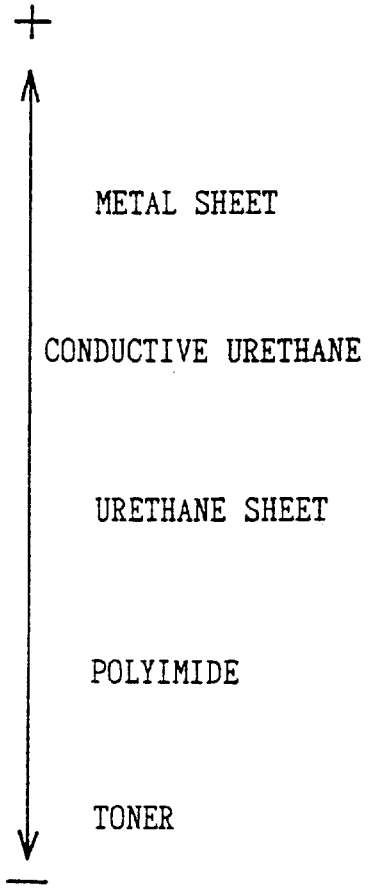
FIG. 3 is a diagram showing an electrification rank of an elastic material in the embodiment of FIG. 1.

FIG. 2 is a view showing a construction in relation to electric field control for image formation in the embodiment of FIG. 1. The developing roller 11 is connected to a bias voltage source 25 of about 0 to +300 V. The control electrode 13 is connected to a control voltage source of about +300 V. The conductive roller 15 is connected to an accelerating voltage source 27 of about +1500 V and operates as an accelerating electrode. A guard electrode 29 supplied with a negative voltage from the repelling voltage source 28 is arranged around the conductive roller 15. A distance D1 between the surface of the developing roller 11 and the surface of the conductive roller 15 is set to 500&Lm to 700 &Lm, for example, and a distance D2 between the surface of the developing roller 11 and the surface of the control electrode 13 is set to 70 &Lm, for example. A thickness t of the FPC 22 is 60 &Lm to 80 &Lm. In a portion of the FPC 22 where the control electrode 13 is not formed are formed a plurality of through holes 30 allowing the toner 12 to pass therethrough. A distance D3 between the surface of the recording material guide 24 and the surface of the control electrode 13 is set to about 200 &Lm, for example. This distance D3 constitutes a space between the surface of the control electrode 13 and the surface of a sheet of recording paper which may be inserted. The conductive roller 15 is protruded by a distance D4 of 0 to 500 &Lm from the surface of the housing 18. The foamed material layer 23 subjects the toner to friction as the roller 11 rotates. The use of a material such as a conductive urethane, an urethane sheet or polyimide located on the electrification rank shown in FIG. 3 can electrify the toner 12 with negative potential. Once the toner 12 is electrified with negative potential the particle jumping condition can be easily controlled by the positive voltage supplied from the control voltage source 26 and the accelerating voltage source 27.

Figure 4:
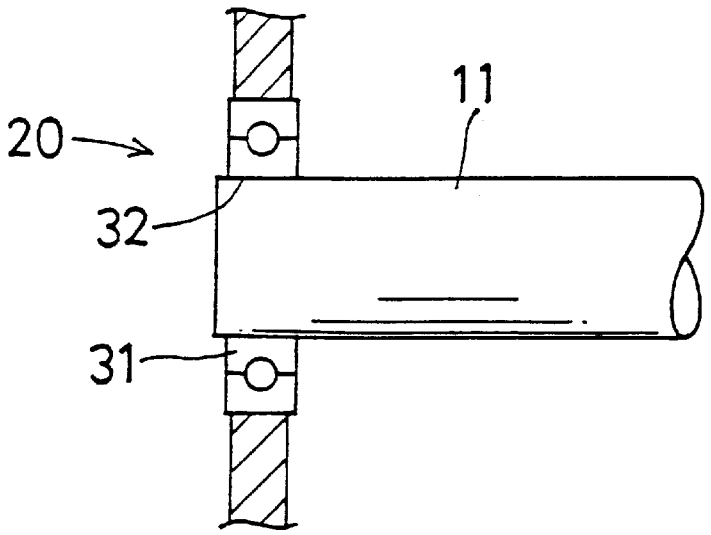
FIG. 4 is a sectional view showing a structure of a bearing of a developing roller in the embodiment of FIG. 1.

FIG. 4 shows a configuration for supporting an axial end of the developing roller 11. The developing roller 11 is generally configured rotatably on the central axis thereof. Due to an unavoidable play existing between the central axis and the outer periphery thereof, however, the developing roller 11 according to the present embodiment is rotatably supported by inserting the outer peripheral surface of the developing roller 11 into a bearing 31 provided in a side wall of the printing unit 20. As a result, the surface of the developing roller 11 can be maintained accurately in position.

Figure 5A:
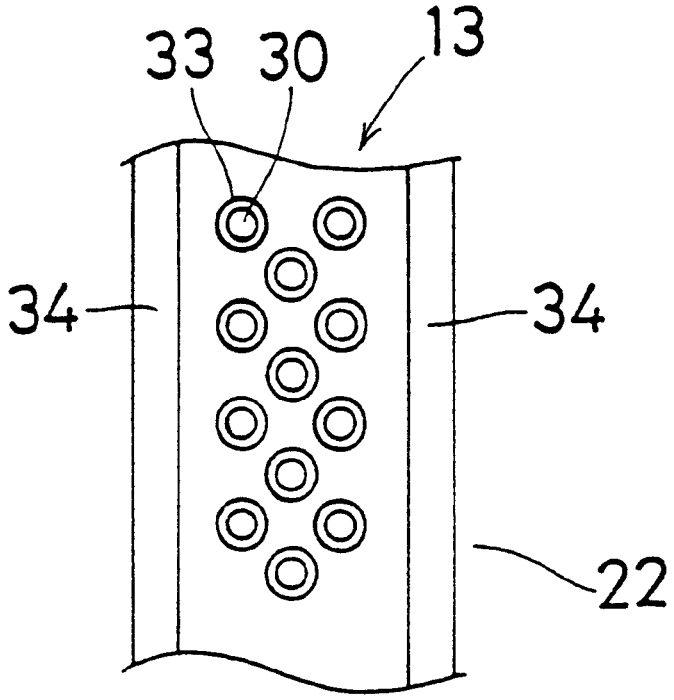
FIGS. 5A and 5B are partial plan views showing a part of a vicinity of a control electrode in the embodiment of FIG. 1.
Figure 5B:
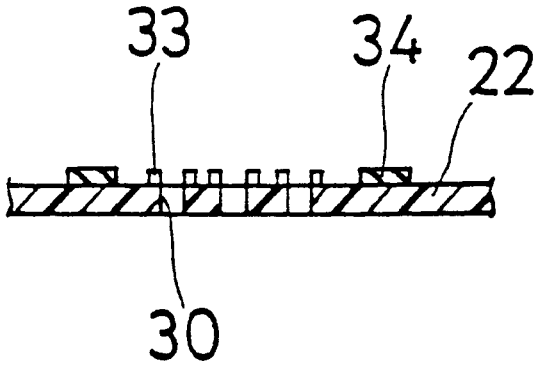

FIG. 5A is a plane view and FIG. 5B is a side sectional view of the control electrode 13. In the surface of the control electrode 13 is formed an electrode pattern 33, and in a central portion of each electrode pattern 33 is formed a through hole 30 for allowing the toner 12 to pass therethrough. An elongated foamed elastic band 34 extending along the axial line of the developing roller 11 is mounted around the electrode pattern 33. Upon pulling the foamed elastic band 34 in the axial direction, the electrode pattern 33 of the FPC is slightly pushed and thereby prevented from waving or the like phenomenon.

Figure 6:
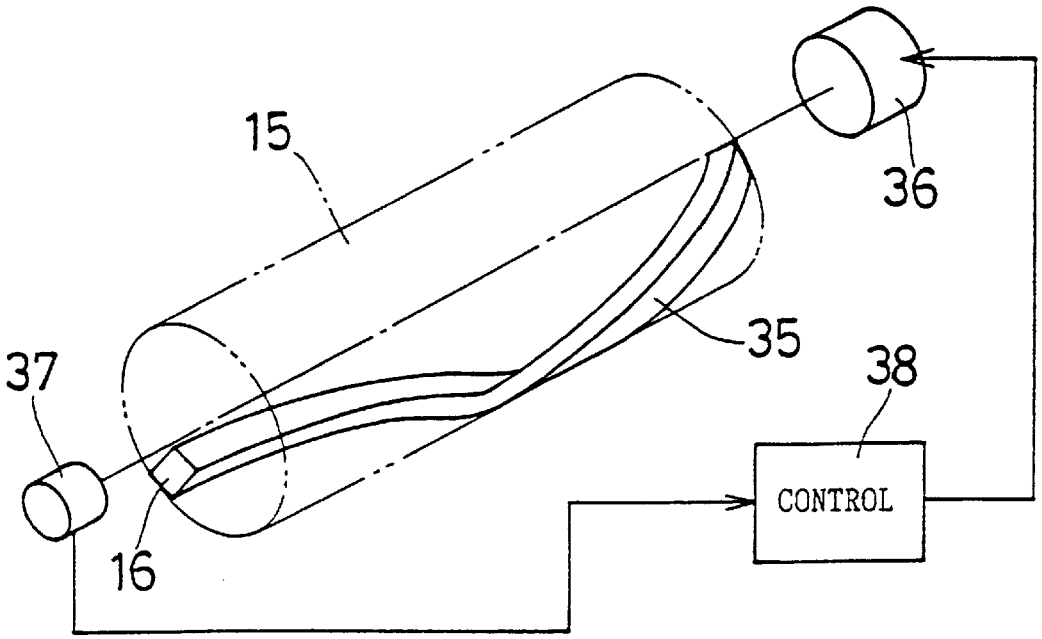
FIG. 6 is a block diagram showing an electrical configuration in relation to rotation drive of a conductive roller in the embodiment of FIG. 1.
Figure 7:
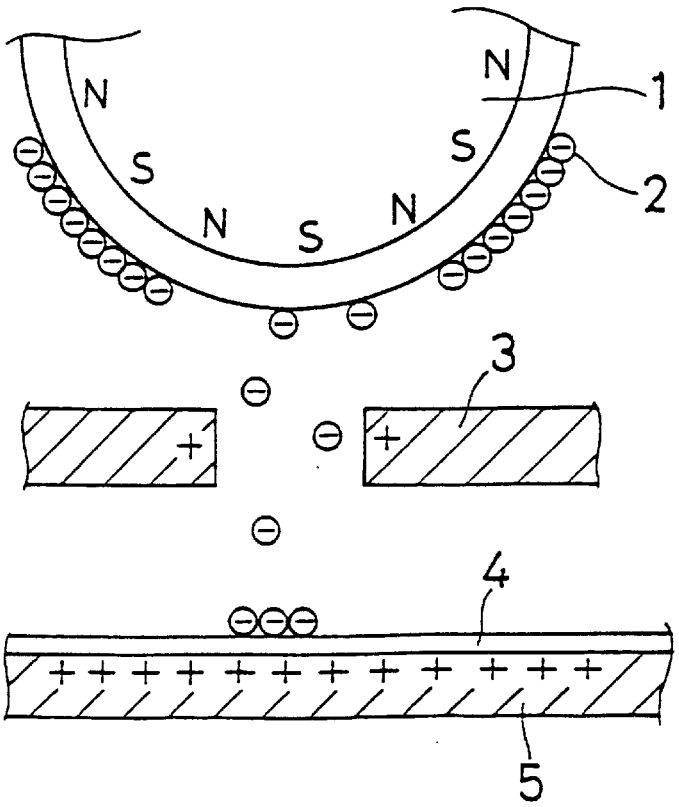
FIG. 7 is a simplified sectional view showing an operating principle of a powder particle jumping recording apparatus of the prior art.

FIG. 6 is a simplified view of a configuration of the magnet 16 contained in the conductive roller 15. The magnet 16 is spiral-shaped and the position of a magnetic pole 35 formed on the surface of the magnet 16 changes along the axial direction. The conductive roller 15 is rotated by a motor 36, and the position of the magnet 16 is detected by position detecting means 37 such as a rotary encoder. In response to an output from the position detecting means 37, control means 38 controls the magnet 35 to switch between a position facing the control electrode and a position far from the control electrode. Suppose a linear magnet 16 is used. With the magnet 16 facing the control electrode, for example, a large magnetic attraction is generated between the magnet 16 and the developing roller, thereby increasing the torque 36 for rotating the conductive roller 15. In the case where the magnet 16 is spiral-shaped, the proportion of the magnetic pole 35 facing the developing roller 11 at a given angle is reduced, so that the torque is appropriately distributed, thereby assuring smooth rotation of the motor.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A powder particle jumping recording apparatus comprising:

a developer carrier for holding a powdery developer having a magnetic property, a printing control electrode disposed so as to be spaced from the developer carrier, an accelerating electrode disposed so as to be spaced from the developer carrier, the developer being jumped by electric field control of the printing control electrode to be accelerated by the accelerating electrode and attached on a recording material inserted between the printing control electrode and the accelerating electrode to be recorded as an image, and an electrode for applying a voltage for repelling the developer jumped by the printing control electrode and accelerated by the accelerating electrode, the electrode being arranged around the accelerating electrode, and wherein the accelerating electrode is composed of a conductive roller partially composed of a magnet and is capable of cleaning the developer attached on the printing control electrode by electric and magnetic fields in a state that the recording material is not inserted and the developer carrier in roller form is rotatably supported on the outer peripheral surfaces at the axial ends, thereof, the apparatus further comprising a cleaning blade for making contact with a surface of the conductive roller of the accelerating electrode to remove the developer attached on the surface of the conductive roller and a removable printing unit including the developer carrier and the printing control electrode, and a removable cleaning unit including the accelerating electrode and the cleaning blade.

2. The powder particle jumping recording apparatus of claim 1, wherein the magnet contained in the accelerating electrode composed of the conductive roller forms magnetic poles in a part of the surface of the conductive roller.

3. The powder particle jumping recording apparatus of any one of claims 1 and 3, wherein the magnet is arranged spirally in the conductive roller.

4. The powder particle jumping recording apparatus of claim 1, the apparatus further comprising position detecting means for detecting a position of the magnet contained in the conductive roller.

5. The powder particle jumping recording apparatus of claim 1, the apparatus further comprising control means for controlling the developer carrier and the accelerating electrode in such a manner that the developer carrier is rotating while the accelerating electrode is stationary, and the accelerating electrode is rotating while the developer carrier is stationary; wherein the developer carrier is formed into a roller.

6. The powder particle jumping recording apparatus of claim 5, wherein the printing control electrode is formed on a curved flexible printed wiring board, the apparatus further comprising a spacer made of an electric material having a thickness of 0.2 mm or less, interposed upstream and downstream of the printing control electrode between the developer carrier and the flexible printed wiring board.

7. The powder particle jumping recording apparatus of claim 6, wherein the elastic material is made of a conductive elastic material, or an elastic material containing an insulating material as a main component thereof which insulating material is located at a position in the electrification rank to cause the developer to be electrified with a predetermined charge under the friction between the insulating material and the developer.

8. The powder particle jumping recording apparatus of claim 6, wherein the curved flexible printed wiring board on which the printing control electrode is formed is pressed by a foamed elastic band extending in the axial direction of the developer carrier in roller form.

* * * * *